US009850744B2

(12) United States Patent
Zhang et al.

(10) Patent No.: US 9,850,744 B2
(45) Date of Patent: Dec. 26, 2017

(54) METHOD FOR EXTRACTING COALBED GAS THROUGH WATER AND COAL DUST DRAINAGE AND A DEVICE THEREOF

(71) Applicant: Shengli Longdi Petroleum Technology & Equipment Co., Ltd., Binzhou, Shandong (CN)

(72) Inventors: Shuhua Zhang, Binzhou (CN); Hongxing Wang, Binzhou (CN); Kechu Han, Binzhou (CN); Hongrong Wang, Binzhou (CN); Qiangkun Zhang, Binzhou (CN)

(73) Assignee: SHENGLI LONGDI PETROLEUM TECHNOLOGY & EQUPIMENT CO., LTD., Binzhou (CN)

( * ) Notice: Subject to any disclaimer, the term of this patent is extended or adjusted under 35 U.S.C. 154(b) by 0 days.

(21) Appl. No.: 14/902,568

(22) PCT Filed: Jul. 21, 2014

(86) PCT No.: PCT/CN2014/082573
§ 371 (c)(1),
(2) Date: Jan. 2, 2016

(87) PCT Pub. No.: WO2015/000446
PCT Pub. Date: Jan. 8, 2015

(65) Prior Publication Data

US 2016/0145979 A1 May 26, 2016

(30) Foreign Application Priority Data

Jul. 3, 2013 (CN) ..... 2013 1 0275438

(51) Int. Cl.
*E21B 43/12* (2006.01)
*E21B 43/00* (2006.01)

(52) U.S. Cl.
CPC ..... *E21B 43/006* (2013.01); *E21B 43/124* (2013.01)

(58) Field of Classification Search
CPC ..... E21B 43/006; E21B 43/124
See application file for complete search history.

(56) References Cited

U.S. PATENT DOCUMENTS 5,372,190 A * 12/1994 Coleman ..... F04F 5/10 166/105
5,501,279 A * 3/1996 Garg ..... E21B 43/006 166/168

(Continued)

FOREIGN PATENT DOCUMENTS

CN 1397717 A 2/2003
CN 1397717 A 2/2003

(Continued)

OTHER PUBLICATIONS

Oct. 15, 2014 International Search Report issued in PCT/CN2014/082573.

*Primary Examiner* — James G Sayre
(74) *Attorney, Agent, or Firm* — Oliff PLC

(57) ABSTRACT

A method for extracting coalbed gas. A wellhead device delivers power fluid into a downhole power fluid pipe in a well shaft, and conveys the fluid to a pump in a pump cylinder connected with the downhole power fluid pipe. The pump sucks in formation fluid via a suction inlet, mixes the fluid with the power fluid to produce a mixed fluid, and conveys the mixed fluid to ground surface. The mixed fluid containing coal dust travels at a flow rate greater than a sedimentation rate of the coal dust, passes though the wellhead device, and flows to the ground surface, thereby preventing a sedimentation of the coal dust. The suction inlet of the pump reaches a lower boundary of a coalbed so as to prevent coal dust from burying the coalbed, and the coalbed (Continued)

gas automatically shoots through an annular space of a well shaft casing.

1 Claim, 3 Drawing Sheets

(56) References Cited

U.S. PATENT DOCUMENTS

| | | | | |
|---|---|---|---|---|
| 7,163,063 | B2 * | 1/2007 | Seams | E21B 43/006 166/309 |
| 7,222,675 | B2 * | 5/2007 | Williams | E21B 17/18 166/105 |
| 8,936,091 | B2 * | 1/2015 | Dudnichenko | E21B 43/006 166/242.8 |
| 2007/0209801 | A1 * | 9/2007 | Williams | E21B 17/18 166/370 |
| 2008/0202757 | A1 | 8/2008 | Wilson | |

FOREIGN PATENT DOCUMENTS

| | | | |
|---|---|---|---|
| CN | 101775975 | | 7/2010 |
| CN | 101775975 | A | 7/2010 |
| CN | 102518412 | A | 6/2012 |
| CN | 102518412 | A | 6/2012 |
| CN | 103321613 | A | 9/2013 |
| CN | 103321613 | A | 9/2013 |
| CN | 203412552 | U | 1/2014 |
| CN | 203412552 | U | 1/2014 |
| WO | 2008033268 | A1 | 3/2008 |
| WO | WO 2008033268 | A1 | 3/2008 |

* cited by examiner

METHOD FOR EXTRACTING COALBED GAS THROUGH WATER AND COAL DUST DRAINAGE AND A DEVICE THEREOF

CROSS-REFERENCE TO RELATED APPLICATION

This application is the U.S. national stage application of International Application No. PCT/CN2014/082573, filed on Jul. 21, 2014. The above-identified patent application is hereby incorporated by reference in its entirety.

TECHNICAL FIELD

The present disclosure relates to coalbed gas extracting, in particular to methods and devices for extracting coalbed gas from an inclined well shaft which contains also water, coal dust and sand.

BACKGROUND

Coalbed gas is a self-generating and self-preserving unconventional natural gas in coalbeds. There are 74 countries in the world that are endowed with coalbed gas resources, while China boasts coalbed gas reserve up to 36.8 trillion cubic meters, ranking No. 3 in the world; China has exploitable coalbed gas resources of about 10 trillion cubic meters. Nowadays, values of such unconventional resource has been recognized; the exploration and utilization of coalbed gas resources have been gradually progressing all over the world.

In the extraction process of coalbed gas, a large amount of coalbed water contained in coalbeds may cause excessively high pressure at the bottom of the coalbed gas well, so that the coalbed gas cannot flow into the well shaft. Therefore, it is required to discharge the coalbed water so as to reduce the pressure at the bottom of the coalbed gas well. In this way, the coalbed gas is able to continuously flow into the well shaft due to a pressure difference generated thereby. In addition, the production characteristics of coalbed gas requires that the coalbed water be stably drained with a reasonable drainage and extraction strength. Due to various restrictions such as topographic conditions, investment scale and national land policies, the drilling mode of multi-well cluster (multiple wells drilled in a well site) is increasingly adopted. As determined by this specific drilling mode, the vast majority of coalbed gas wells have inclined shafts. Combined with a shallow burial depth of coalbed that dictates a small hole curvature radius of the coalbed gas well, the following problems are resulted in the drainage and extraction process of coalbed water.

Firstly, the coal gas well is greatly sloped and having a small hole curvature radius. Even the existing vertical wells have such problems as serious hole deviation and high rate of overall angle change. The commonly used sucker-rod pumps (e.g., tubing pumps and screw pumps) thus suffer from serous abrasion of rods and tubes, resulting in high consumption of rod and tube materials as well as frequent workover operations.

Secondly, the output coalbed water contains coal dust and fracturing sand (this is because all the coal gas wells are put to production after fracturing). This leads to frequent faults (such as corrosion of rods, pipes and pumps, pump blocking and stuck pumps) in the existing coalbed water lifting devices (e.g., tubing pumps, screw pumps and electrical submersible pumps), which cause frequent workover operations.

Thirdly, most of the coal gas wells have a water yield less than the minimal discharge capacity requirement of electrical submersible pumps, and therefore do not comply with the well selection criteria of electrical submersible pumps.

Fourthly, although the operating conditions of sand discharge and oil extraction methods are relatively similar to the technical requirements for coalbed gas extraction through drainage of water and coal dust, the methods have yet to be applied in the field of coalbed gas extraction through water and coal dust drainage. Necessary modifications and improvements are to be made to the technical structure of the well shaft as well as to the methods themselves before they can be applied to coalbed gas extraction through water and coal dust drainage.

To sum up, the conventional coalbed water lifting technology employed nowadays would cause frequent workover operations on coalbed gas wells, significantly increasing the production cost of coalbed gas extraction. In addition, the frequent workover operations on coal gas wells may most easily cause damage to the reservoir bed and directly affect the extraction performance of coalbed gas.

SUMMARY

The following summary is illustrative only and is not intended to be limiting in any way. That is, the following summary is provided to introduce concepts, highlights, benefits and advantages of the novel and non-obvious techniques described herein. Select implementations are further described below in the detailed description. Thus, the following summary is not intended to identify essential features of the claimed subject matter, nor is it intended for use in determining the scope of the claimed subject matter.

Implementations of the present disclosure relate to a method for extracting coalbed gas through a water and coal dust drainage, which is so designed that the water and coal dust contained in the coalbed can be sufficiently sucked into a hydraulic jet pump and then discharged to the surface of the ground.

The implementations further relate to a device for realizing the method described above.

The implementations include: a method for extracting coalbed gas through a water and coal dust drainage. The method involves providing a power fluid into a downhole power fluid pipe in a well shaft via a wellhead device. The wellhead device is provided with a flow channel system such that the power fluid is transported into a hydraulic jet pump disposed inside a pump cylinder connected with the downhole power fluid pipe. Accordingly, the hydraulic jet pump starts to work to suck a formation fluid into the hydraulic jet pump through a suction inlet at a lower part of the hydraulic jet pump.

The method also involves forming a mixed fluid by mixing the formation fluid with the power fluid.

The method further involves transporting the mixed fluid upwards to ground, wherein the mixed fluid contains coal dust. The mixed fluid is transported by a downhole mixed fluid pipe in the well shaft, and the downhole mixed fluid pipe has a small flow channel cross section such that the mixed fluid containing the coal dust flows upward through the wellhead device to the ground at a flow rate higher than a sedimentation rate of the coal dust. Accordingly, a sedimentation of the coal dust is prevented. Also, the pump cylinder reaches a lower boundary of a coalbed, which prevents the coal dust from burying the coalbed.

The method still involves collecting the coalbed gas by a ground gas collecting device. The coalbed gas reaches the ground through an annular space inside a shaft casing.

In addition, a device for extracting coalbed gas through a water and coal dust drainage according to the present disclosure is realized in the following manner. This device is provided with a wellhead device having a flow channel system. This device is also provided with a power fluid inlet on the wellhead device connected with a downhole power fluid pipe in a shaft casing through the flow channel system in the wellhead device. This device is also provided with a mixed fluid outlet on the wellhead device connected with a downhole mixed fluid pipe in a shaft through the flow channel system in the wellhead device. This device is also provided with a hydraulic jet pump connected with the downhole power fluid pipe and the downhole mixed fluid pipe. The hydraulic jet pump includes a pump cylinder configured to be placed at a lower boundary of a coalbed.

When the method for extracting coalbed gas through water and coal dust drainage as well as the device thereof are adopted, the power fluid enters the hydraulic jet pump through the wellhead device and the downhole power fluid pipe. This enables the hydraulic jet pump to operate. The hydraulic jet pump sucks in formation fluid that contains both water and coal dust, and mixes the formation fluid with the power fluid to form a mixed fluid. The mixed fluid is transported upwards to the well head through a downhole mixed fluid pipe and discharged to the ground, completing the drainage and extraction of the coalbed water that contains coal dust. With the discharge of the coalbed water, the bottom-hole pressure of the coalbed gas well (i.e., the pressure at the bottom of the well at the working fluid level) is gradually decreased. When the bottom-hole pressure (at the working fluid level) of the coalbed gas well has dropped to a certain extent, the coalbed gas enters the well shaft under the action of the produced differential pressure. Since the density of the coalbed gas is much less than the density of the coalbed water, the coalbed gas thus moves upwards along an annular space inside the shaft casing and enters the ground gas collecting device through a gas well casing valve. The pump cylinder of the hydraulic jet pump is located at the lower boundary of the coalbed, which prevents the coal dust from burying the coalbed. Since no packer is provided under the well shaft, it is feasible to timely detect and record data such as the casing-head pressure and the working fluid level of the gas well. The speed of water drainage can be reasonably controlled by adjusting technical parameters of the downhole hydraulic jet pump and the pressure of the power fluid, so as to meet the requirement for drainage and extraction of the coalbed water. Furthermore, there is no moving components under the shaft, so there is no issue of sucker rod side-abrasion. Therefore, through the adoption of this method and the device thereof, the drainage and extraction process of coalbed water containing coal dust is simplified, the production cost significantly reduced, and the overall benefits of extracting the coalbed gas enhanced.

DETAILED DESCRIPTION OF THE PREFERRED EMBODIMENTS

Figure 1:
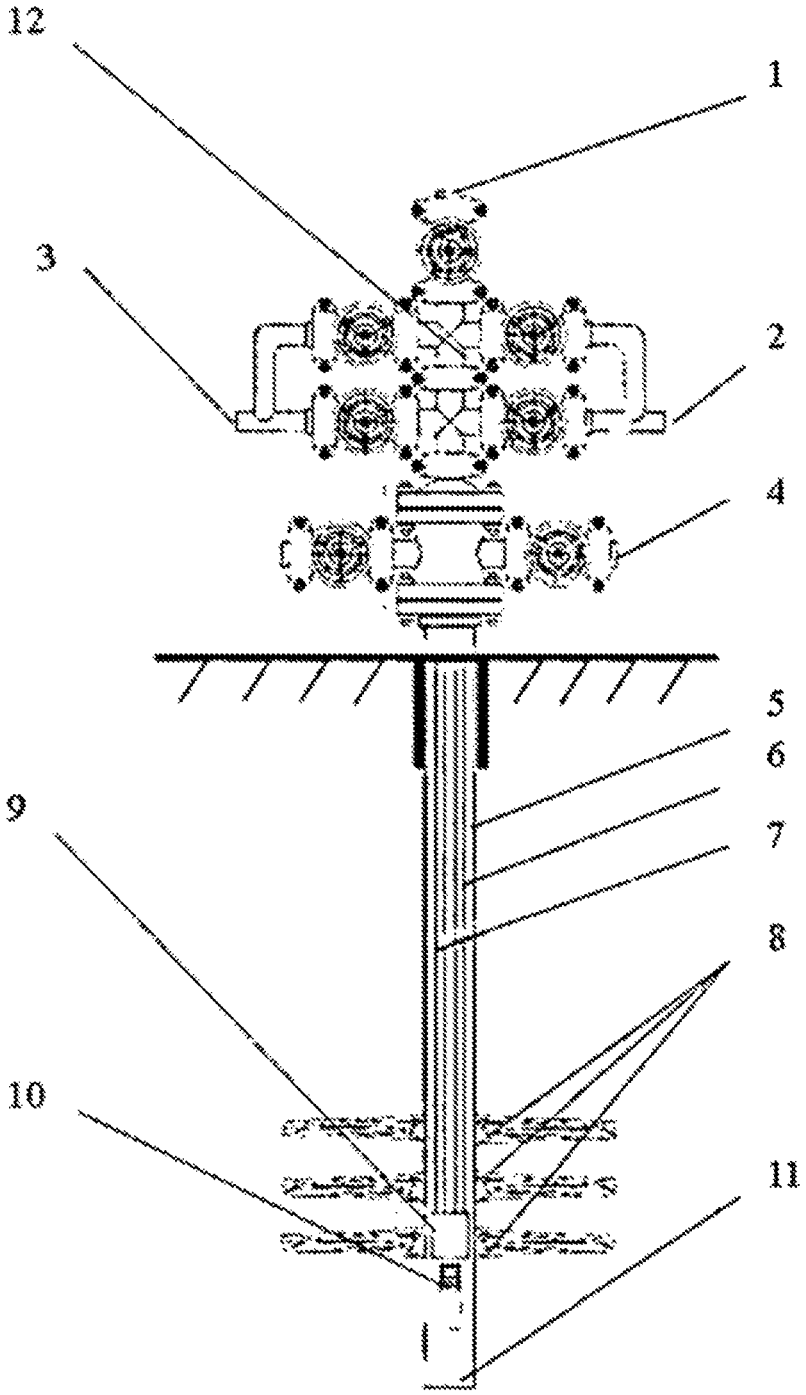
FIG. 1 is a schematic diagram of an embodiment of a device for extracting coalbed gas through water and coal dust drainage according to the present disclosure.

The present disclosure is described in detail with reference to the attached figures.

As shown in the attached figures, a device for extracting coalbed gas through water and coal dust drainage according to the present disclosure is realized in following manner. This device is provided with wellhead device 12 having a flow channel system. Power fluid inlet 2 on the wellhead device is connected with downhole power fluid pipe 7 in shaft casing 5 through the flow channel system in the wellhead device. Mixed fluid outlet 3 on the wellhead device is connected with downhole mixed fluid pipe 6 in the well shaft through the flow channel system in the wellhead device. The downhole power fluid pipe and the downhole mixed fluid pipe are connected with hydraulic jet pump 9. Suction inlet 10 of the hydraulic jet pump is located at the lower boundary of coalbed.

The operating principle of this device is described in view of a positive circulation of the power fluid, as follows. The power fluid of high pressure drives the downhole hydraulic jet pump to work. The flow channel of the downhole mixed pipe has a small cross section area, so that the mixed fluid containing coal dust flows upward to the ground through mixed fluid outlet 3 on the wellhead device at a flow rate much higher than the sedimentation rate of cost dust. As the coalbed water containing coal dust is discharged with control, the coalbed gas is able to continuously flow into the well shaft. Subsequently, under the action of downhole flow pressure at the bottom of the well, the coalbed gas moves along an annular space between shaft casing 5 and downhole power fluid pipe 7, through casing valve 4 of the wellhead device, and eventually reaches the ground and flows onwards.

The upward sending of the mixed fluid containing coal dust is completed by the flow channel of the downhole mixed fluid pipe in the well shaft. The flow channel of the downhole mixed fluid pipe has a cross-section area less than a cross-section area of the flow channel of the downhole power fluid pipe, such that the mixed fluid containing coal dust flows upwards at a flow rate much greater than a sedimentation rate of coal dust.

Figure 3:
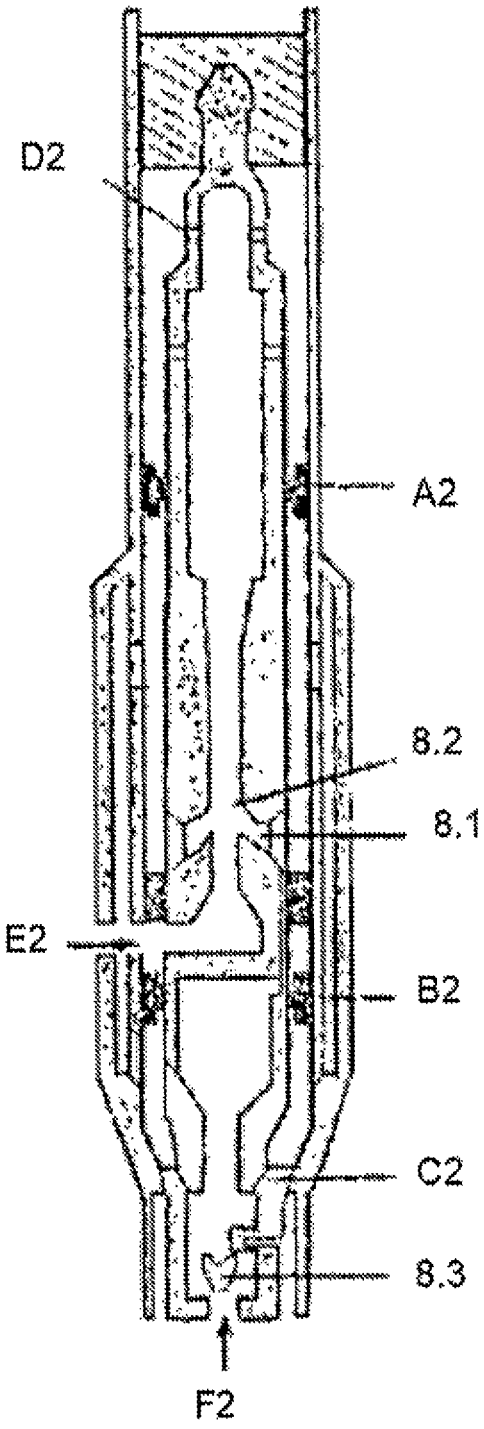
FIG. 3 is a structure diagram of a hydraulic jet pump in a power fluid reverse circulation mode in a device for extracting coalbed gas through water and coal dust drainage according to the present disclosure.

Referring to FIGS. 1 and 3, a device for extracting coalbed gas through water and coal dust drainage according to the present disclosure is described in view of a reverse circulation of the power fluid, as follows. This device is provided with wellhead device 12 having a flow channel system. Power fluid inlet 2 on the wellhead device is connected with downhole power fluid pipe 7 in shaft casing 5 through the flow channel system in the wellhead device. Mixed fluid outlet 3 on the wellhead device is connected with downhole mixed fluid pipe 6 in the well shaft through the flow channel system in the wellhead device. The downhole power fluid pipe and the downhole mixed fluid pipe are connected with hydraulic jet pump 9. Suction inlet 10 of the downhole hydraulic jet pump is located at the lower boundary of coalbed. The power fluid of high pressure drives the downhole hydraulic jet pump to work. Through an optimized design of the flow channel cross-section area of the downhole mixed fluid pipe, along with a reasonable allocation of the quantity of the power fluid, the mixed fluid containing coal dust is configured to flow upwards at a flow rate much greater than the sedimentation rate of oil reservoir coal dust, thus able to reach the ground through mixed fluid outlet 3 on the wellhead device. As the coalbed water containing coal dust is discharged with control, the coalbed gas is able to continuously flow into the well shaft. Subsequently, under the action of downhole flow pressure at the bottom of the well, the coalbed gas moves along an annular space between shaft casing 5 and downhole power fluid pipe 7, through casing valve 4 of the wellhead device, and eventually reaches the ground and flows onwards. The undermost end of the well shaft is an artificial well bottom 11.

When the pump core of the hydraulic jet pump is transported to the downhole, the pulling-running tool 1 on the wellhead device can be used to send the pump core down the downhole power fluid pipe, and the power fluid is then used to send the pump core to the operating position in the pump cylinder.

When it is necessary to move the pump core of the hydraulic jet pump out of the downhole and to the ground, power fluid can be injected into the mixed fluid outlet so that the flow direction of the power fluid is opposite to that of the normal operating. This way, the hydraulic jet pump can be sent upwards along the downhole power fluid pipe to the pulling-running tool on the well head, so as to be taken out.

As the coalbed water is being discharged, the bottom-hole pressure of the coalbed gas well gradually decreases, which enables the coalbed gas to flow into the well shaft along cracks in the coalbed and then subsequently reach a gas collective device located on the ground through the annular space inside the shaft casing.

The high pressure power fluid required by the downhole hydraulic jet pump is provided by a ground power fluid pump. The coalbed water output by the coalbed gas well can be adopted as the power fluid and can be put into cycle use after a simple sedimentation process. The coalbed water output by various coalbeds 8 in the coalbed gas well is discharged to the ground and then enters the water collecting system.

Figure 2:
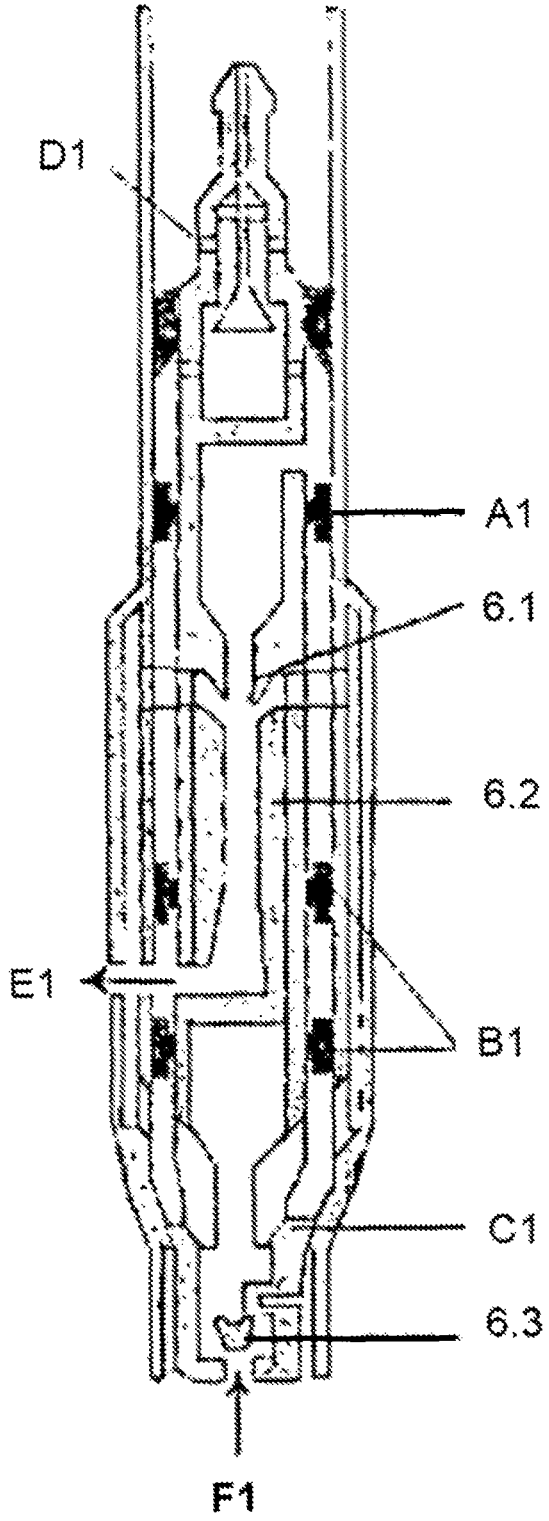
FIG. 2 is a structure diagram of a hydraulic jet pump in a power fluid positive circulation mode in a device for extracting coalbed gas through water and coal dust drainage according to the present disclosure.

As shown in FIG. 2, first O-ring A1 is used for the sealing between the power fluid and the output fluid. Second O-ring B1 is used for the sealing between the output fluid and the mixed fluid. First pump core seat C1 is used to support the hydraulic jet pump core. The power fluid enters the hydraulic jet pump through flow channel D1 of the first power fluid pump core, and the mixed fluid flows out from mixed fluid outlet E1. First nozzle 6.1 is provided in the pump core of the hydraulic jet pump, first throat pipe 6.2 is provided under the first nozzle, and first check valve 6.3 is mounted in first formation fluid inlet F1 at a lower part of the pump body.

As shown in FIG. 3, third O-ring A2 is used for sealing between the power fluid and the output fluid. Fourth O-ring B2 is used for the sealing between the power fluid and the output fluid. Second pump core seat C2 is used to support the hydraulic jet pump core. The power fluid enters the hydraulic jet pump through flow channel E2 of the second power fluid pump core, and the mixed fluid flows out from mixed fluid outlet D2. Second nozzle 8.1 is provided in the pump core of the hydraulic jet pump, second throat pipe 8.2 is provided under the second nozzle, and second check valve 8.3 is mounted in second formation fluid inlet F2 at a lower part of the pump body.

Additional Notes

The herein-described subject matter sometimes illustrates different components contained within, or connected with, different other components. It is to be understood that such depicted architectures are merely examples, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

Further, with respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

Moreover, it will be understood by those skilled in the art that, in general, terms used herein, and especially in the appended claims, e.g., bodies of the appended claims, are generally intended as "open" terms, e.g., the term "including" should be interpreted as "including but not limited to," the term "having" should be interpreted as "having at least," the term "includes" should be interpreted as "includes but is not limited to," etc. It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to implementations containing only one such recitation, even when the same claim includes the introductory phrases "one or more" or "at least one" and indefinite articles such as "a" or "an," e.g., "a" and/or "an" should be interpreted to mean "at least one" or "one or more;" the same holds true for the use of definite articles used to introduce claim recitations. In addition, even if a specific number of an introduced claim recitation is explicitly recited, those skilled in the art will recognize that such recitation should be interpreted to mean at least the recited number, e.g., the bare recitation of "two recitations," without other modifiers, means at least two recitations, or two or more recitations. Furthermore, in those instances where a convention analogous to "at least one of A, B, and C, etc." is used, in general such a construction is intended in the sense one having skill in the art would understand the convention, e.g., "a system having at least one of A, B, and C" would include but not be limited to systems that have A alone, B alone, C alone, A and B together, A and C together, B and C together, and/or A, B, and C together, etc. In those instances where a convention analogous to "at least one of A, B, or C, etc." is used, in general such a construction is intended in the sense one having skill in the art would understand the convention, e.g., "a system having at least one of A, B, or C" would include but not be limited to systems that have A alone, B alone, C alone, A and B together, A and C together, B and C together, and/or A, B, and C together, etc. It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

From the foregoing, it will be appreciated that various implementations of the present disclosure have been described herein for purposes of illustration, and that various modifications may be made without departing from the scope and spirit of the present disclosure. Accordingly, the various implementations disclosed herein are not intended to be limiting, with the true scope and spirit being indicated by the following claims.

What is claimed is:

1. A device for extracting coal bed gas through a water and coal dust drainage, the device comprising:

a wellhead device having a flow channel system;

a power fluid inlet on the wellhead device connected with a downhole power fluid pipe in a well shaft through the flow channel system in the wellhead device, the power fluid inlet providing a power fluid into the downhole power fluid pipe such that the power fluid is transported into a hydraulic jet pump disposed inside a pump cylinder connected with the downhole power fluid pipe and such that the hydraulic jet pump starts to work to suck a formation fluid into the hydraulic jet pump through a suction inlet at a bottom part of the hydraulic jet pump;

a mixed fluid outlet on the wellhead device connected with a downhole mixed fluid pipe in the well shaft through the flow channel system in the wellhead device, the mixed fluid outlet transporting the mixed fluid upwards to ground, wherein the mixed fluid contains coal dust and is transported by a downhole mixed fluid pipe in the well shaft, the downhole mixed fluid pipe having a flow channel cross section smaller than a flow channel cross section of the downhole power fluid pipe such that the mixed fluid containing the coal dust flows upward through the wellhead device to the ground at a flow rate higher than a sedimentation rate of the coal dust and such that sedimentation of the coal dust is prevented, wherein the pump cylinder reaches a bottom boundary of a coalbed so as to prevent the coal dust from burying the coalbed, the hydraulic jet pump being connected with the downhole power fluid pipe and the downhole mixed fluid pipe, the suction inlet being configured to be placed at the bottom boundary of the coalbed;

a nozzle disposed in a pump core of the hydraulic jet pump, the hydraulic jet pump configured to operate in a power fluid reverse circulation mode;

a throat pipe provided under the nozzle;

a check valve mounted in a formation fluid inlet at the lower part of the hydraulic jet pump;

a pump core seat mounted under the pump core of the hydraulic jet pump;

a power fluid pump core flow channel through which power fluid is configured to enter the hydraulic jet pump; and a mixed fluid outlet from which mixed fluid is configured to flow out.

* * * * *